US011784401B1

(12) United States Patent
Greve

(10) Patent No.: US 11,784,401 B1
(45) Date of Patent: Oct. 10, 2023

(54) COMBINATION DRIVEN AND PARASITIC ELEMENT CIRCULARLY POLARIZED ANTENNA

(71) Applicant: Video Aerial Systems, LLC, Madison Heights, VA (US)

(72) Inventor: Charles A. Greve, Amherst, VA (US)

(73) Assignee: VIDEO AERIAL SYSTEMS, LLC, Madison Heights, VA (US)

( * ) Notice: Subject to any disclaimer, the term of this patent is extended or adjusted under 35 U.S.C. 154(b) by 759 days.

(21) Appl. No.: 16/576,632

(22) Filed: Sep. 19, 2019

(51) Int. Cl.
*H01Q 21/00* (2006.01)
*H01Q 1/50* (2006.01)
*H01P 3/08* (2006.01)

(52) U.S. Cl.
CPC ..... *H01Q 1/50* (2013.01); *H01P 3/081* (2013.01)

(58) Field of Classification Search
CPC ... H01P 3/08; H01P 3/081; H01Q 15/16; H01Q 15/168; H01Q 1/14; H01Q 1/36; H01Q 1/42; H01Q 1/48; H01Q 1/50; H01Q 9/18; H01Q 13/06; H01Q 19/00; H01Q 1/28; H01Q 1/282; H01Q 21/00; H01Q 21/06; H01Q 21/24; H01Q 21/245; H01Q 5/37; H01Q 5/371; H01Q 9/30
See application file for complete search history.

(56) References Cited

U.S. PATENT DOCUMENTS

| | | | | |
|---|---|---|---|---|
| 3,656,166 | A | 4/1972 | Klopach et al. | |
| 8,717,250 | B2* | 5/2014 | Nilsson | H01Q 15/16 343/893 |
| 9,711,866 | B1* | 7/2017 | Doane et al. | H01Q 19/13 |
| 2007/0069970 | A1* | 3/2007 | Argaman et al. | H01Q 15/168 343/912 |
| 2013/0249769 | A1* | 9/2013 | Higaki et al. | H01Q 3/24 343/876 |
| 2014/0266958 | A1* | 9/2014 | Doskocil | H01Q 21/26 343/893 |
| 2017/0346194 | A1 | 11/2017 | Chamberland | |
| 2019/0386383 | A1* | 12/2019 | Shehan et al. | H01Q 1/52 |

FOREIGN PATENT DOCUMENTS

KR 101315546 B1 10/2013

* cited by examiner

*Primary Examiner* — Tho G Phan
(74) *Attorney, Agent, or Firm* — Rupak Nag

(57) ABSTRACT

Provided are examples of circularly polarized omni-directional antennas which contain an equal number of driven radiators and parasitic radiators spaced radially around a central axis which in which the driven elements are fed from a central feed system. This type of antenna allows for a compact size with higher axial ratio than other designs. In one aspect, an antenna comprises 2 or more elements shaped as a single curve in a cylindrical structure. In another aspect, the antenna may take on an angular form such as a square or a hexagon in which the elements may contain multiple angles. The antenna may be contained within a non-conductive enclosure and may contain a transmission line such as a coaxial cable.

14 Claims, 13 Drawing Sheets

COMBINATION DRIVEN AND PARASITIC ELEMENT CIRCULARLY POLARIZED ANTENNA

TECHNICAL FIELD

The present disclosure relates generally to antenna systems, and more specifically to circularly polarized omnidirectional antennas for use in video piloting, unmanned vehicles (aircraft and ground), mesh networking, and Wi-Fi applications

BACKGROUND

Antennas are electrical devices which convert electric power into radio waves, and vice versa. They are usually used with a radio transmitter or radio receiver. In transmission, a radio transmitter supplies an electric current to the antenna's terminals, and the antenna radiates the energy from the current as electromagnetic waves (radio waves). In reception, an antenna intercepts some of the power of an electromagnetic wave in order to produce an electric current at its terminals, and is applied to a receiver to be amplified.

Typically an antenna consists of an arrangement of metallic conductors (elements), electrically connected (often through a transmission line) to the receiver or transmitter. Antennas may also include additional elements or surfaces with no electrical connection to the transmitter or receiver, such as parasitic elements, parabolic reflectors or horns, which serve to direct the radio waves into a beam or other desired radiation pattern.

Antennas can be designed to transmit and receive radio waves in all horizontal directions equally (omnidirectional antennas), or preferentially in a particular direction (directional or high gain antennas). An omnidirectional antenna is a class of antenna which radiates radio wave power uniformly in all directions in one plane, with the radiated power decreasing with elevation angle above or below the plane, dropping to zero on the antenna's axis. Omnidirectional antennas oriented vertically are widely used for non-directional antennas on the surface of the Earth because they radiate equally in all horizontal directions, while the power radiated drops off with elevation angle so little radio energy is aimed into the sky or down toward the earth and wasted. Omnidirectional antennas are widely used for radio broadcasting antennas, and in mobile devices that use radio such as cell phones, FM radios, walkie-talkies, wireless computer networks, cordless phones, GPS as well as for base stations that communicate with mobile radios, such as police and taxi dispatchers and aircraft communications.

Often reduced size is required for certain installations where traditional circular antennas may not be used. In order to generate a proper circular wave, spacing is required between elements of certain types which makes the size limited for circular antennas driven by only one method. Using a combination of driven and parasitic elements within a single structure allows for significant reduction in antenna size while still achieving a circular wave.

A common type of closed loop circularly polarized antenna can be found in the Lindenblad type antenna in which 4 closed loop single plane elements are placed around a central axis. The current disclosure uses a combination of connected as well as parasitic elements in the structure to achieve significant size reduction.

Another form of the Lindenblad known as the "parasitic lindenblad" uses a central dipole to drive 4 parasitic elements. This allows for slightly higher gain as well as slightly reduced size compared to the driven Lindenblad type antennas, but the vertical size is often problematic as it is fixed. The present disclosure uses driven elements in the same system as the parasitic elements in order to reduce the vertical size of the antenna. In addition, Lindenblad antennas are primarily square with straight elements where the present disclosure may be curved or contain compound bends.

SUMMARY

The following presents a simplified summary of the disclosure in order to provide a basic understanding of certain embodiments of this disclosure. This summary is not an extensive overview of the disclosure, and it does not identify key and critical elements of the present disclosure or delineate the scope of the present disclosure. Its sole purpose is to present some concepts disclosed herein in a simplified form as a prelude to the more detailed description that is presented later.

Provided are examples of circularly polarized omni-directional antennas which use a combination of driven elements as well as non-electrically connected elements (called parasitic radiators or parasitic elements) located around a central axis which allow for a very compact form of circularly polarized antenna. The present disclosure has an equal number of parasitic radiators and driven elements which may be as few as one (1) of each type or as many as eight (8) of each type. Therefore the total number of elements (driven and parasitic) is always an even number. For example, an antenna may contain two (2) driven elements and therefor contain two (2) parasitic elements. The elements of the present disclosure may be straight, curved, or have a compound bend system such as commonly referred to as a "z-bend".

The driven elements and the parasitic elements may be of different form factors and lengths depending on the performance and size of the antenna desired. For example, the driven elements may be of a compound curve such as a "Z-bend" while the parasitic elements may comprise only one curve around the central axis.

Both the driven elements and the parasitic elements are made from a conductive material such as copper or brass. The elements may be made from a metallic wire (such as copper or silver) or may be embedded within a printed circuit board (pcb).

The antenna further comprises a central transmission line which is electrically connected to the driven elements through a central transmission system (such as a microstrip trace) but does not connect to the parasitic elements. This central transmission system is then connected to a transmission line such as a coaxial cable which extends through the center of the antenna structure. Additionally, this central transmission system may contain and impedance matching system which may allow for even further reduced size of the antenna.

In certain embodiments the antenna comprises a protective cover made from non-conductive material such as plastic or wood. This cover may enclose all or only a portion of the antenna. The cover may also provide mechanical support for the conductive elements.

Other implementations of this disclosure include corresponding devices, systems, and computer programs, configured to perform the actions of the described method. For instance, a system is provided comprising a receiver and an antenna as previously described. In some embodiments, the antenna is coupled to the receiver via a coaxial radio frequency (RF) connector that is coupled to the second end of the cable. In some embodiments, the antenna is directly coupled to a circuit board of a receiver. These other implementations may each optionally include one or more of the following features.

In another aspect, which may include at least a portion of the subject matter of any of the preceding and/or following examples and aspects, a method for constructing an antenna is provided. APCB is installed on the second end of a coaxial cable. A plurality of radiating elements embedded within a PCB is bonded to the central PCB. This assembly is then installed into a non-conductive enclosure and sealed.

These and other embodiments are described further below with reference to the figures.

DETAILED DESCRIPTION OF EXAMPLE EMBODIMENTS

Figure 1A:
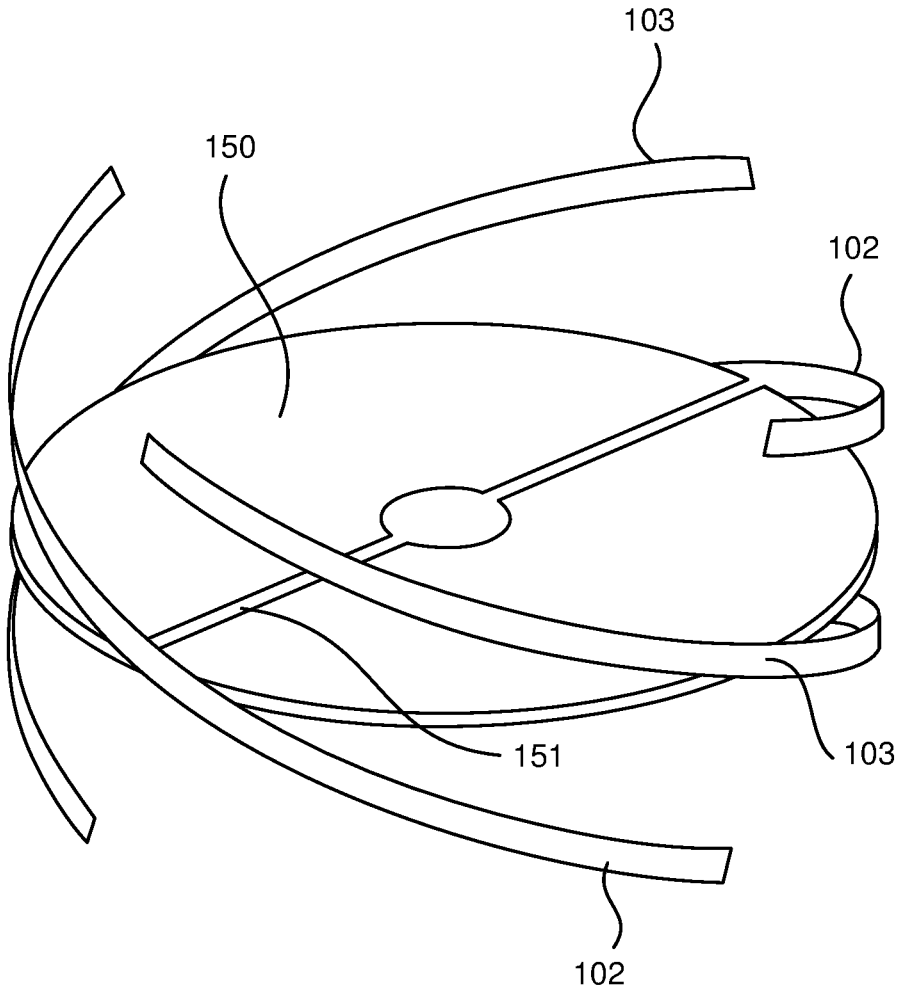
FIGS. 1A, 1B, and 1C are perspective views of example omni-directional antennas in circular or cylindrical form in accordance with one or more embodiments.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

For example, the techniques of the present invention will be described in the context of particular machines, such as drones. However, it should be noted that the techniques of the present invention apply to a wide variety of different machines that may require remote wireless control. As another example, the techniques of the present invention will be described in the context of particular wireless signals, such as Wi-Fi. However, it should be noted that the techniques of the present invention apply to a wide variety of different wireless signals, including Bluetooth, infrared, line of sight transmission mechanisms, as well as various other networking protocols.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise. For example, a system uses a processor in a variety of contexts. However, it will be appreciated that a system can use multiple processors while remaining within the scope of the present invention unless otherwise noted. Furthermore, the techniques and mechanisms of the present invention will sometimes describe a connection between two entities. It should be noted that a connection between two entities does not necessarily mean a direct, unimpeded connection, as a variety of other entities may reside between the two entities. For example, a processor may be connected to memory, but it will be appreciated that a variety of bridges and controllers may reside between the processor and memory. Consequently, a connection does not necessarily mean a direct, unimpeded connection unless otherwise noted.

Various embodiments are provided which describe a circularly polarized omni-directional antenna. Such antennas may have implementations in a variety of fields, including, but not limited to video piloting, unmanned vehicles (aircraft and ground), mesh networking, and Wi-Fi applications. In various embodiments, the antenna uses a combination of one or more driven elements and parasitic elements surrounding a central axis in which the number of driven elements is the same as the number of parasitic elements. The driven elements are each connected to a conductive pathway such as a microstrip line located in the center of the antenna. The parasitic elements are not electrically connected to the central microstrip feed system. The antenna may be contained within a non-conductive enclosure which protects the antenna and supports the inner antenna structure.

Figure 1B:
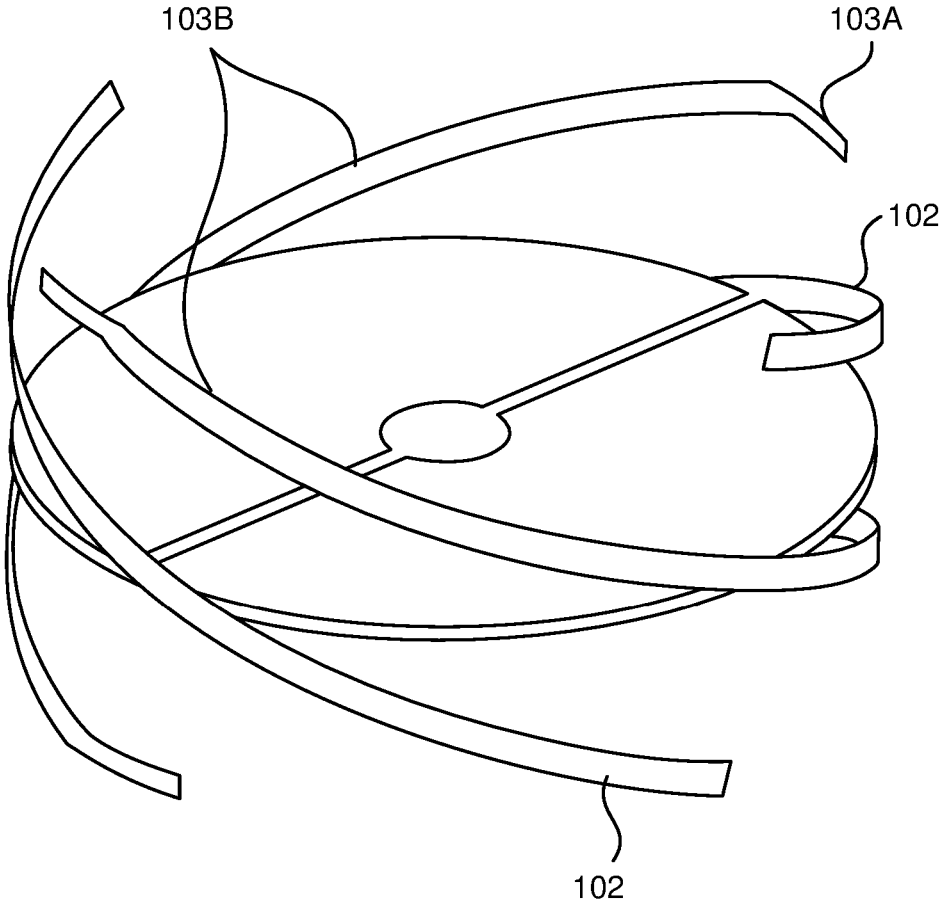
Figure 1C:
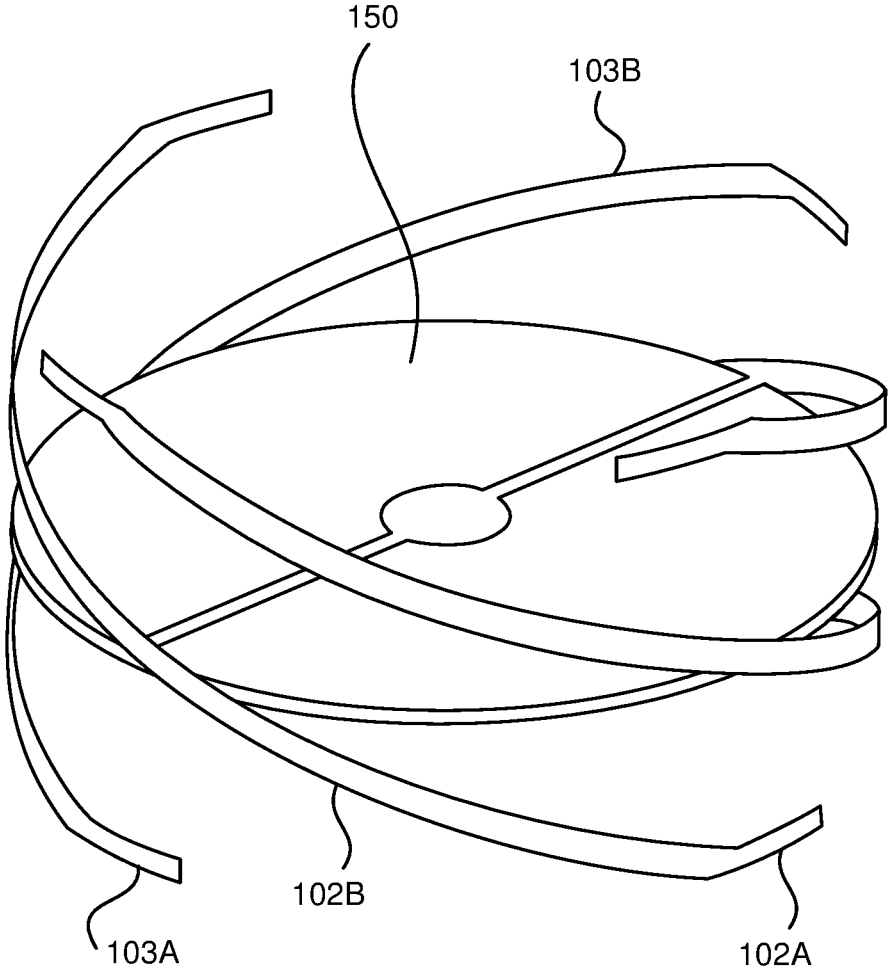
Figure 1D:
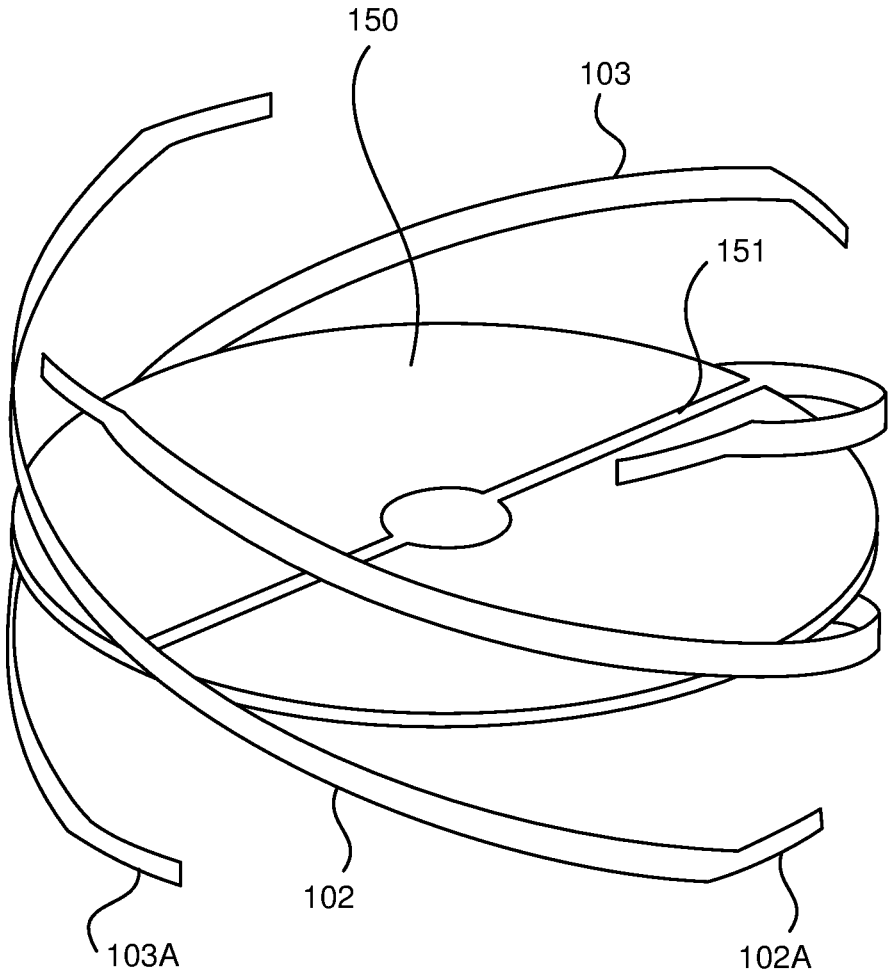

With reference to FIGS. 1A, 1B, and 1C shown are perspective views of an example circularly polarized omni-directional antenna 100, in accordance with one or more embodiments. In various embodiments, antenna 100 includes a plurality of conductive elements 101 which may be comprised of an equal number of driven elements 102 and parasitic elements 103. The elements are placed axially around a central feed system 150 which comprises a conductive pathway 151 for each driven element 101. The central feed system may be a printed circuit board (PCB) or conductive metal. The elements within the plurality of conductive elements may be curved, straight, angular, or any combination of curved, straight and/or angular forms.

With reference to FIG. 1A, shown is a perspective view of an example antenna in which each element in the plurality of conductive elements 101 is curved. The length and width of the driven elements 102 may be the same as the parasitic elements 103 or may be of different lengths or widths than the parasitic elements 103. The included angle θ from horizontal may be between 5 and 62 degrees. The conductive pathway 151 is electrically bonded to each driven element 102 within the plurality of conductive elements 101.

With reference to FIG. 1B, shown is a perspective view of an example antenna in which the driven elements 102 within the plurality of conductive elements 101 are curved and each parasitic element 103 within the plurality of conductive elements is a combination of curved and angular. The parasitic elements 103 may be comprised of central portion 103B and an end portion 103A. The end portion 103A may be horizontal or may be angled. Additionally, the central portion 103B may be angled, vertical, or horizontal.

With reference to FIG. 1C, shown is a perspective view of an example antenna in which the parasitic elements 103 within the plurality of conductive elements 101 are curved and angular and each driven element 102 within the plurality of conductive elements is a combination of curved and angular as well. The driven elements 102 may be comprised of central portion 102B and an end portion 102A. The end portion 102A may be horizontal or may be angled. Additionally, the central portion 102B may be angled, vertical, or horizontal. The parasitic element central portion 103B may be angled, vertical, or horizontal but not necessarily of the same form as the driven elements 102.

Figure 2A:
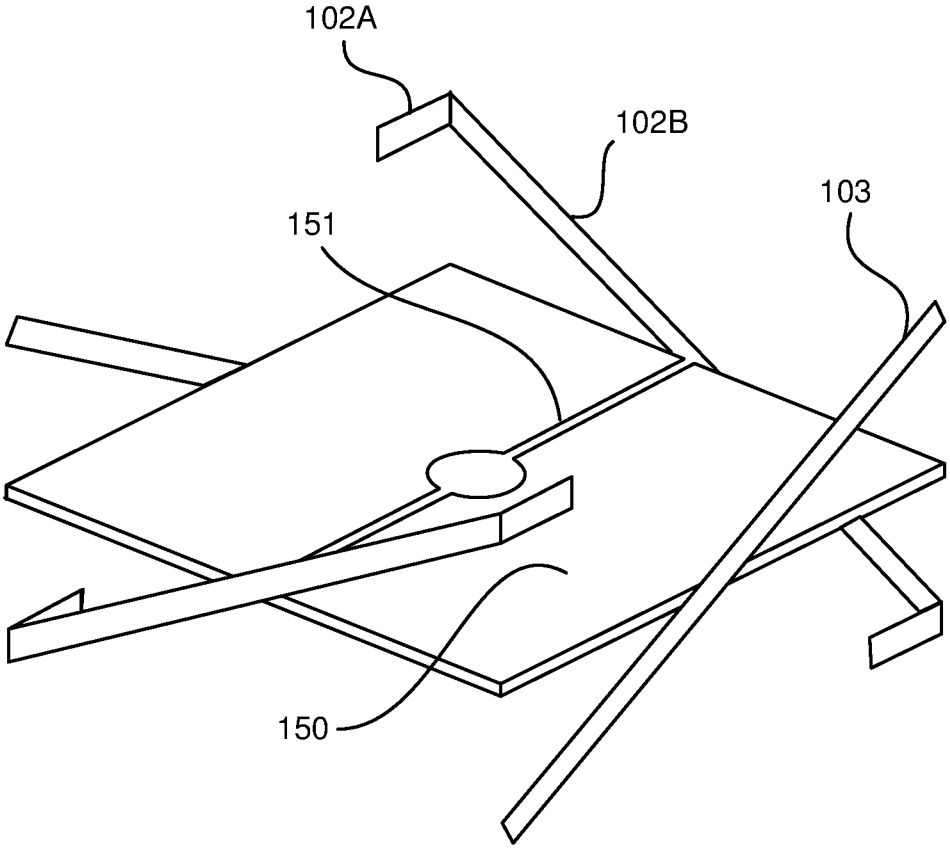
FIGS. 2A, 2B, 2C, and 2D are perspective views of example omni-directional antennas in angular form in accordance to one or more embodiments.

With reference to FIG. 2A shown is a perspective of example circularly polarized antenna in which the antenna structure is angular and the number of both the parasitic elements 103 and the driven elements 102 within the plurality of conductive elements 101 is two (2). The driven elements 102 within the plurality of conductive elements 101 are a combination of straight and angular. The driven elements 102 may be broken into a central portion 102B and a tip portion 102A. The central portion 102B may be horizontal, vertical, or any angle between horizontal and vertical. The tip portion 102B may be horizontal or angled.

Figure 2B:
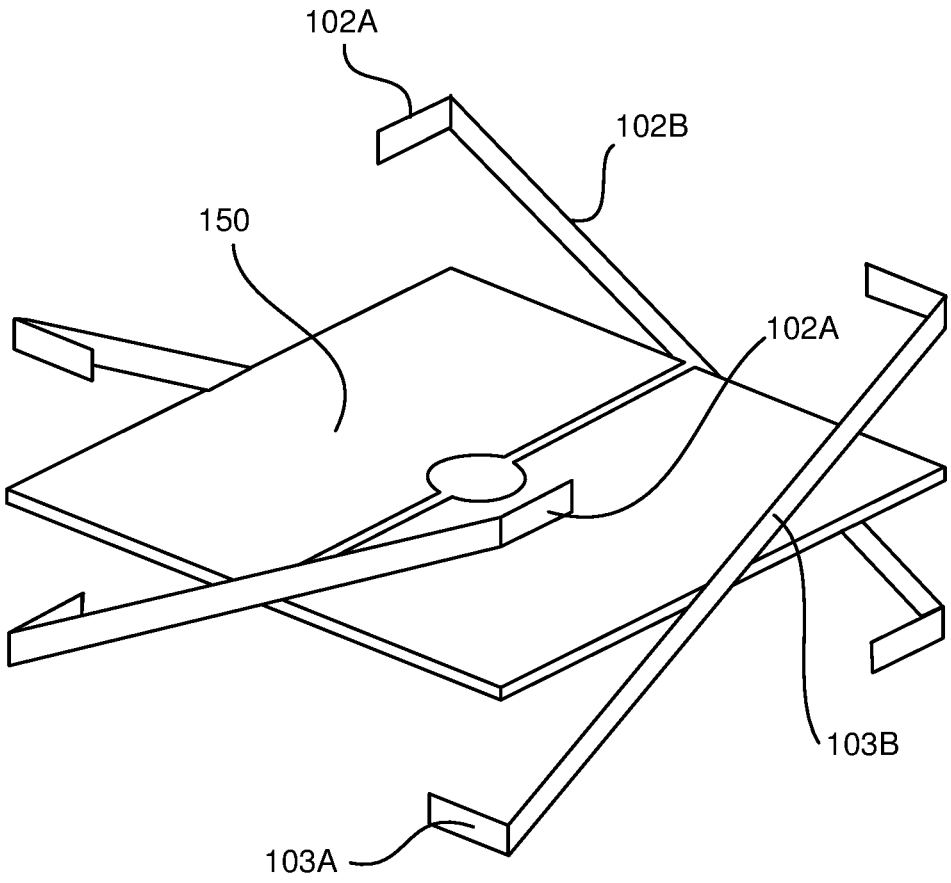

FIG. 2B illustrates an example circularly polarized antenna 100 in which the antenna structure is angular and both the driven elements 102 and the parasitic elements 103 are a combination of straight and angular. The driven elements 102 within the plurality of conductive elements 101 may or may not be of the same size, length, or width as the parasitic elements 103. The driven elements 102 may be broken into a central portion 102B and a tip portion 102A. The central portion 102B may be horizontal, vertical, or any angle between horizontal and vertical. The tip portion 102B may be horizontal or angled. Additionally, the parasitic elements may be broken into a central portion 103B and an end portion 103A. The central portion 103B may be horizontal, vertical, or any angle in between. The end portion 103A may be horizontal or angled. The form of the driven elements 102 may not be of the same form as the parasitic elements 103.

Figure 2C:
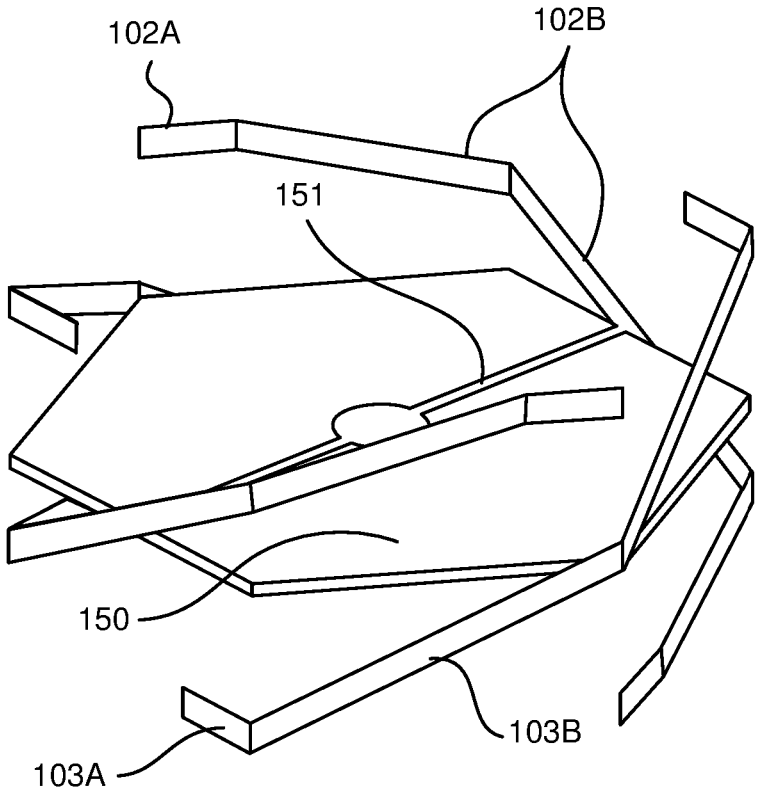

FIG. 2C illustrates an example circularly polarized antenna 100 in which the antenna structure is angular, but the number of angles within the central feed system 150 and the number of elements within the plurality of conductive elements 101 are not equal. In this example, the elements are of angular form and present multiple angles. The number of angles within the driven elements 102 may or may not be the same as the number of angles in the parasitic elements 103.

Figure 2D:
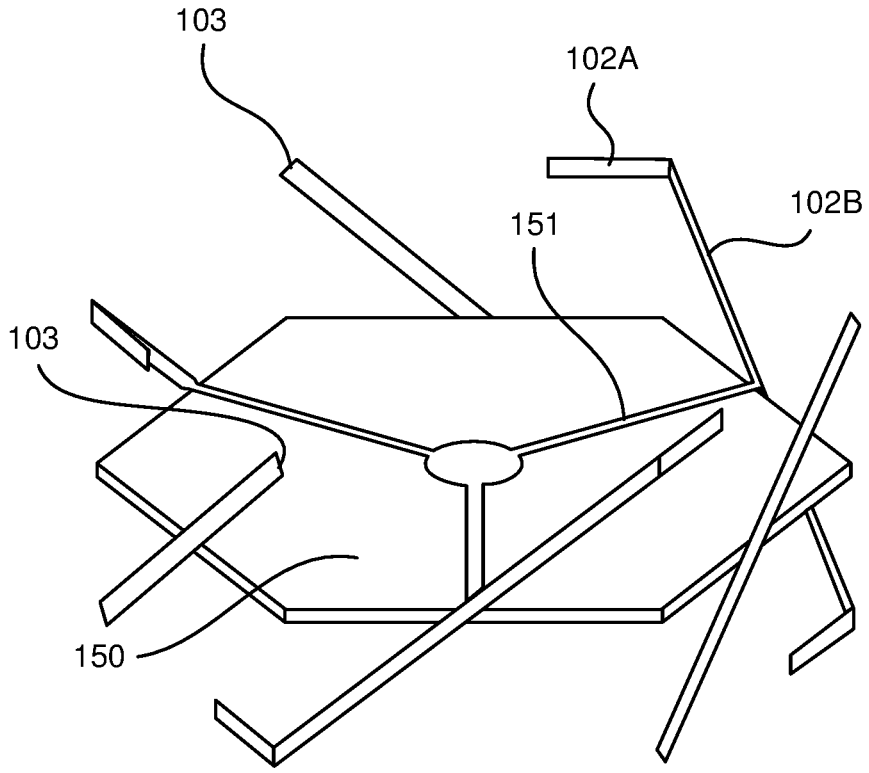

FIG. 2D illustrates an example angular form circularly polarized antenna 100 in which the number of driven elements 102 and the number of parasitic elements 103 is three (3). Each driven element 102 within the plurality of conductive elements 101 is electrically bonded to a conductive pathway 151 within the central feed system 150. The central feed system may be a PCB, air, or any non-conductive material.

Figure 3A:
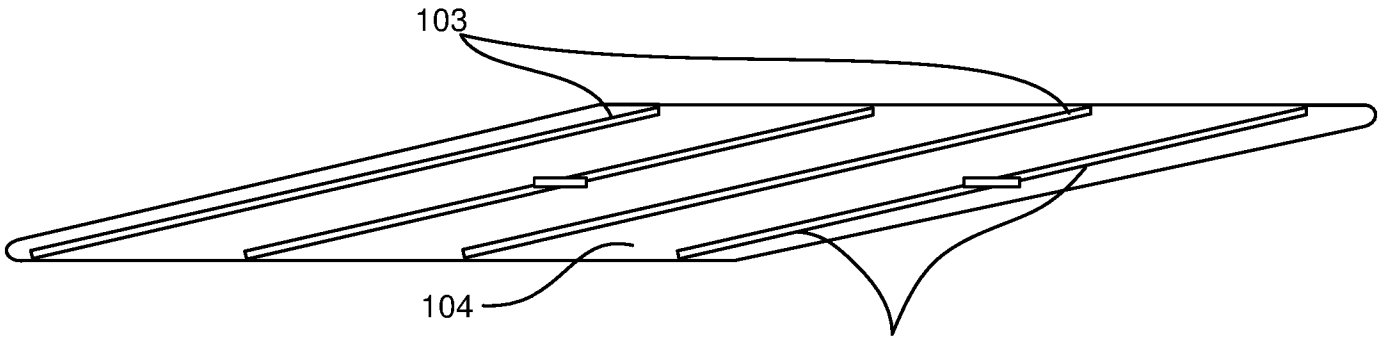
FIGS. 3A, and 3B illustrate perspective views on a plurality of radiating elements embedded within a printed circuit board (PCB) in accordance with one or more embodiments.
Figure 3B:
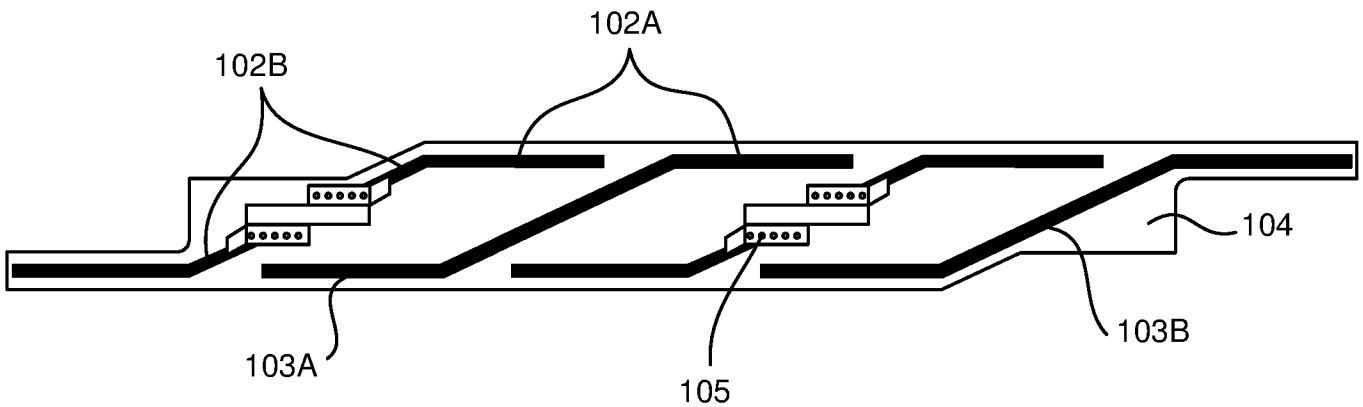

With reference to FIGS. 3A, and 3B, shown are examples of the plurality of conductive elements 101 embedded within a printed circuit board 104. The printed circuit board 104 may be a flexible PCB or a semi-rigid PCB such as FR4. Each driven element 102 within the plurality of conductive elements 101 contains a bonding point 105 which may be bonded to the conductive pathway 151.

FIG. 3A illustrates an example of a plurality of conductive elements 101 in which Both the driven elements 102 and the parasitic elements 103 are to be curved or angled when placed around the central feed system 150. The printed circuit board 104 may be flexible or semi-rigid.

FIG. 3B illustrates an example of a plurality of conductive elements 101 embedded within a printed circuit board 104 in which both the driven elements 102 and the parasitic elements 103 are of angular form. The driven elements 102 contain a bonding point 105 in which each driven element 102 may be electrically bonded to the conductive pathway 151.

Figure 4A:
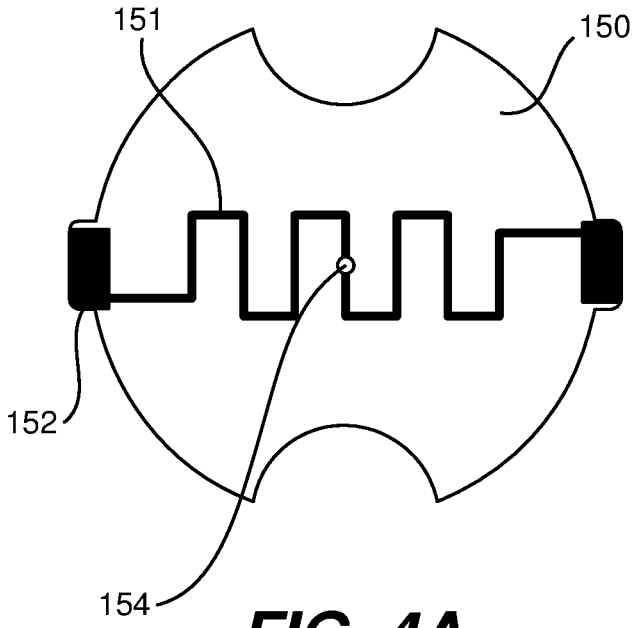
FIGS. 4A, and 4B illustrate example central feed systems for an omni-directional antenna embedded within a PCB in accordance to one or more embodiments.
Figure 4B:
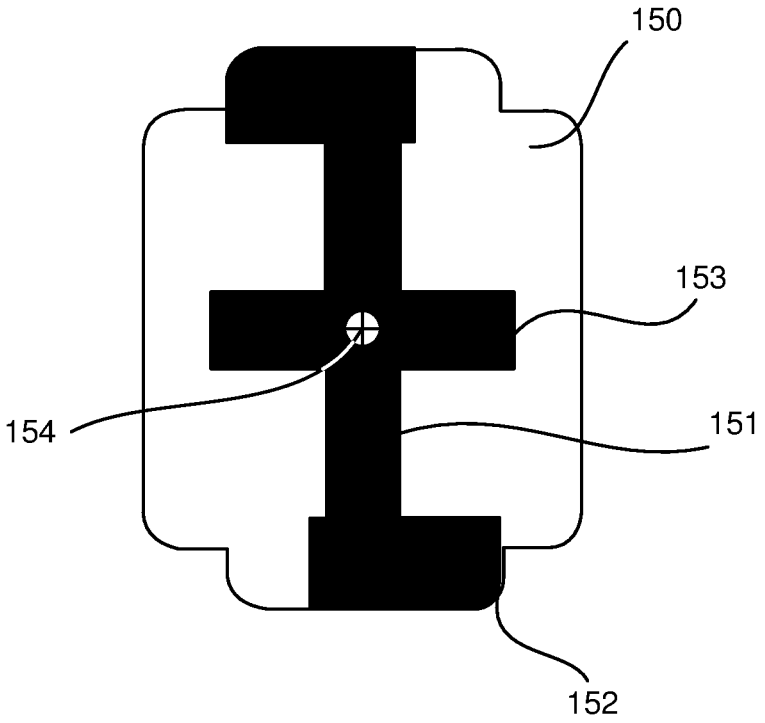

With reference to FIGS. 4A and 4B, shown are perspective views of example central feed systems 150 made from a printed circuit board. The conductive pathway 151 comprises a copper trace 151 which contains a bonding point 152. The bonding point 152 will be bonded to a driven element 102 within the plurality of conductive elements 101. At the center of the conductive pathway 151 there is a feedline bonding point 153. This feedline bonding point may be an exposed pad, a hole, or a combination of both which serves to connect the antenna to a feedline 501. The central feed system may further incorporate tuning sections 154 which serve to tune the antenna to a desired impedance. The tuning sections 154 may be traces on a PCB.

Figure 5:
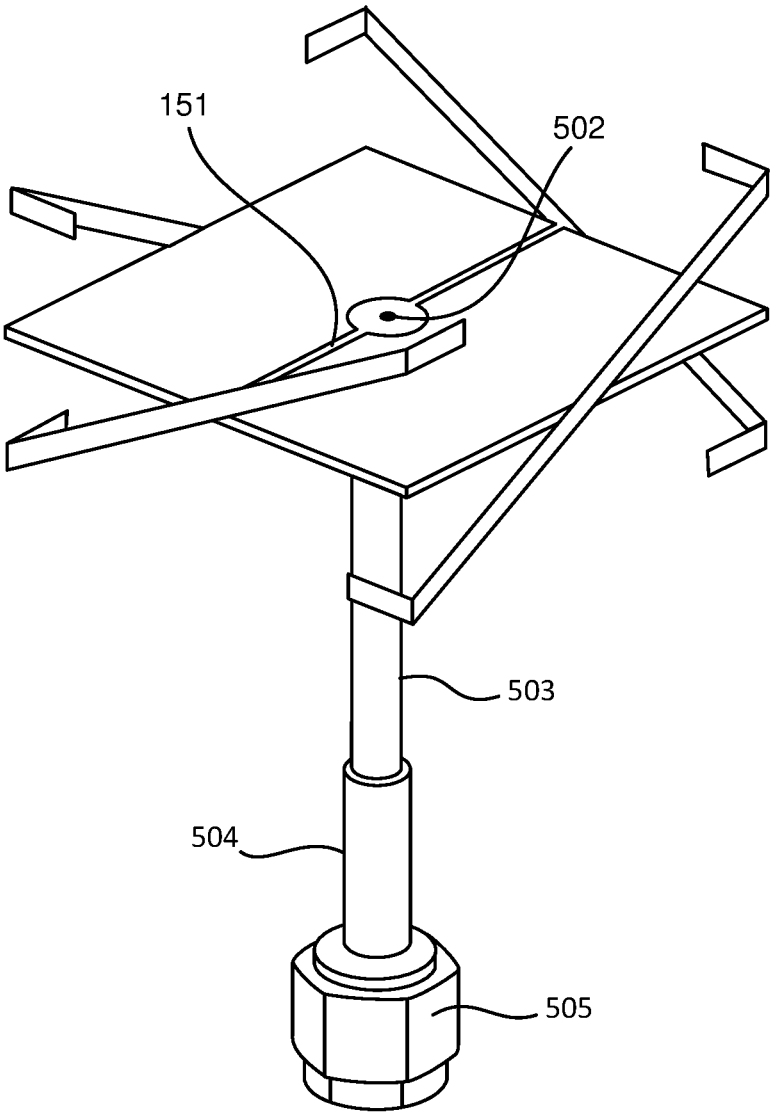
FIG. 5 is a perspective view of an example antenna with a connected transmission line in accordance with one or more embodiments.

With reference to FIG. 5, shown is an example circularly polarized antenna 100 mounted on a coaxial feedline 501. The coaxial feedline comprises an inner conductor 502 and an outer shield 504 separated by an insulating material 503. The secondary end of the coaxial feedline 501 inner conductor 502 is electrically bonded to the top portion of the conductive pathway 151. The outer shield 504 is bonded to the lower portion of the conductive pathway 151. The second end of the coaxial feedline 501 may contain an electrical connector 505 such as a Sub-miniature A (SMA), MCX, MMCX, IPEX, or similar connector.

Figure 6:
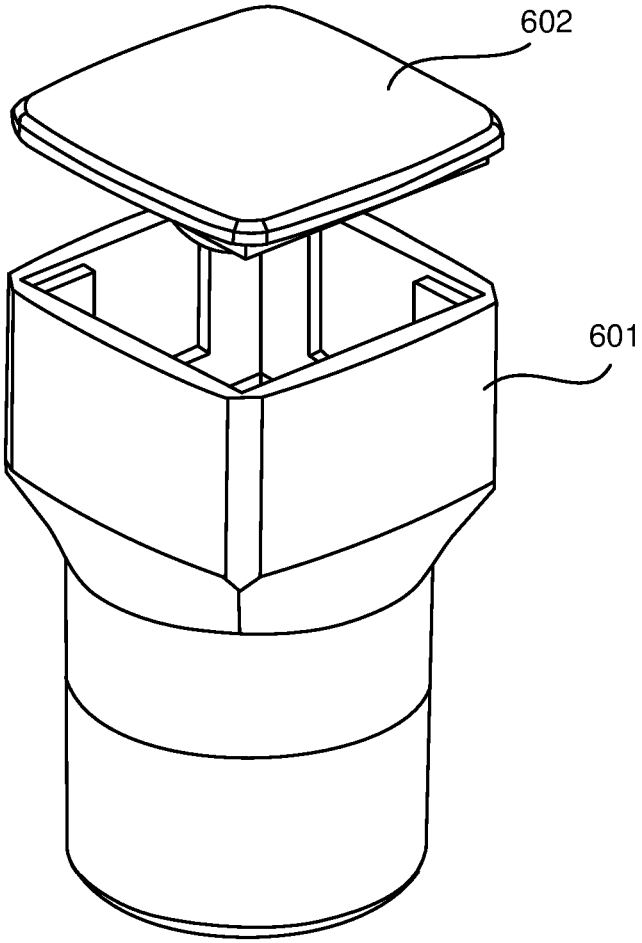
FIG. 6 is an example of a non-conductive enclosure for a circularly polarized antenna in accordance with one or more embodiments.

With reference to FIG. 6, shown is a perspective view of an example non-conductive cover 600 for a circularly polarized antenna 100. The non-conductive cover 600 may comprise a lower portion 601 and an upper portion 602. The lower portion 601 may be bonded to the upper portion 602 by method of adhesive, ultrasonic welding or an interference fit. The non-conductive cover 600 may be made of any non-conductive material such as plastic, wood, or cardboard.

Figure 7:
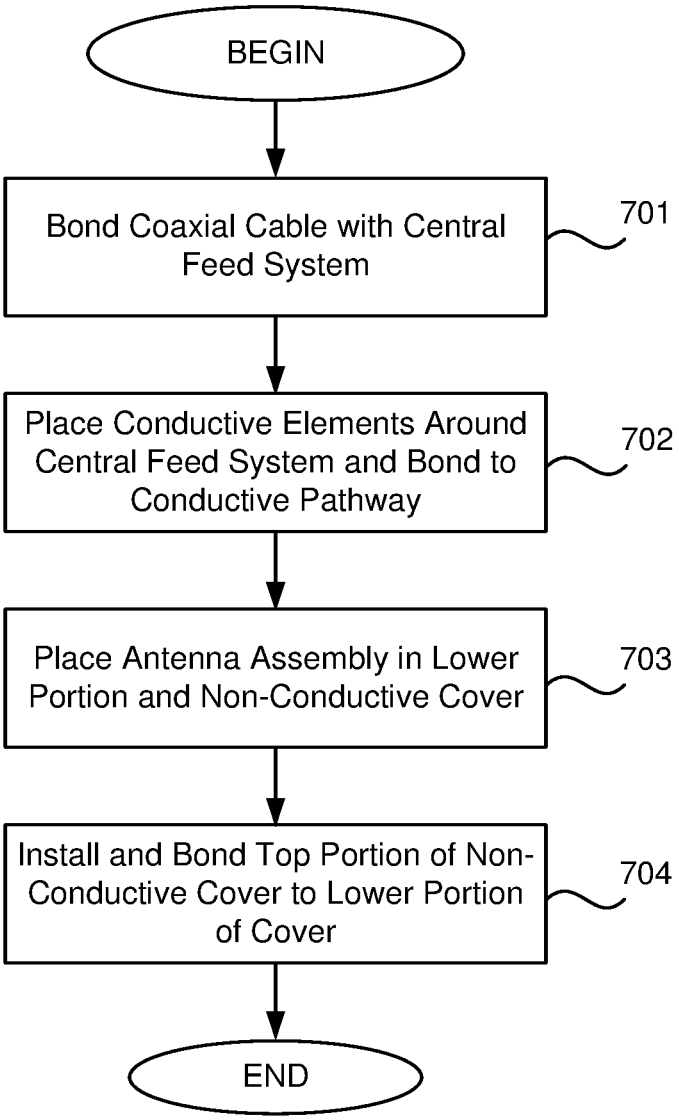
FIG. 7 is a flow diagram of a method for assembling a compact circularly polarized antenna in accordance with one or more embodiments.

FIG. 7 is a flow diagram of a method of assembling a circularly polarized antenna 100. At step 701 a coaxial cable 500 is bonded to the central feed system 150. At step 702, the plurality of conductive elements 101 are placed around the central feed system 150 and bonded to the conductive pathway 151. At step 703, the antenna assembly is placed inside the lower portion of a non-conductive cover 601. At step 704, the top portion of the non-conductive cover 602 is installed and bonded to the lower portion 601.

Although many of the components and processes are described above in the singular for convenience, it will be appreciated by one of skill in the art that multiple components and repeated processes can also be used to practice the techniques of the present disclosure.

While the present disclosure has been particularly shown and described with reference to specific embodiments thereof, it will be understood by those skilled in the art that changes in the form and details of the disclosed embodiments may be made without departing from the spirit or scope of the disclosure. It is therefore intended that the disclosure be interpreted to include all variations and equivalents that fall within the true spirit and scope of the present disclosure including those which may, for example use straight conductors without curves as conductive elements. Although many of the components and processes are described above in the singular for convenience, it will be appreciated by one of skill in the art that multiple components and repeated processes can also be used to practice the techniques of the present disclosure. In addition, it shall be understood by someone skilled in the art that antennas may be phased or stacked into an array which may be an application of the present disclosure.

What is claimed is:

1. An antenna comprising:

a plurality of conducting elements each conductive element spaced equidistantly from each other, each conductive element on a circumference around a center axis of the antenna;

wherein one or more of the conductive elements is an electrically connected element and wherein one or more of the conductive elements is a non-electrically connected element and wherein a number of electrically connected and of a number of non-electrically connected elements are equal;

a central feed system electrically connecting each electrically connected element to a central point and wherein the central feed system is connected to a transmission line; and a non-conductive cover encapsulating the antenna.

2. The antenna of claim 1, wherein the plurality of conducting elements is curved about the center axis of the antenna.

3. The antenna of claim 1, wherein the plurality of conducting elements is located within an enclosure.

4. The antenna of claim 1, wherein each element within the plurality of conductive elements contains one or more curves.

5. The antenna of claim 1, wherein each conductive element within the plurality of conductive elements is straight.

6. The antenna of claim 1, wherein the dimensions of the electrically connected elements are not the same as dimensions of the non-electrically connected elements.

7. The antenna of claim 1, wherein the plurality of conducting elements is included in a printed circuit board, in which the printed circuit board curved around the central axis.

8. The antenna of claim 1, wherein the plurality of conducting elements includes two electrically connected and two non-electrically connected elements.

9. The antenna of claim 1, wherein each conductive element within the plurality of conducting elements includes a metallic wire.

10. The antenna of claim 1, wherein the central feed system is electrically bonded to the electrically connected elements within the plurality of conductive elements.

11. The antenna of claim 1, wherein the central feed system is electrically bonded to a coaxial cable.

12. The antenna of claim 1, wherein the plurality of conducting elements and the central feed system are contained within a non-conductive enclosure.

13. The antenna of claim 1,wherein the central feed system further comprises:

one or more metallic traces, wherein each metallic trace is connected to said electrically connected element and is connected to a centrally located coaxial cable.

14. The antenna of claim 1, further comprising:

a radio device and a coaxial cable connecting the antenna to the radio device.

* * * * *